US005525945A

United States Patent [19]

Chiappetta et al.

[11] Patent Number: 5,525,945

[45] Date of Patent: Jun. 11, 1996

[54] DIELECTRIC RESONATOR NOTCH FILTER WITH A QUADRATURE DIRECTIONAL COUPLER

[75] Inventors: Mark C. Chiappetta, Berwyn; John S. Daukas, Hartsville, both of Pa.

[73] Assignee: Martin Marietta Corp., East Windsor, N.J.

[21] Appl. No.: 205,212

[22] Filed: Jan. 27, 1994

[51] Int. Cl.[6] ..... H01P 1/20

[52] U.S. Cl. ..... 333/202; 333/219.1; 333/235

[58] Field of Search ..... 333/110, 116, 333/126, 134, 202, 204, 219.1, 235; 331/96, 107 DP, 107 SL

[56] References Cited

U.S. PATENT DOCUMENTS

| | | | |
|---|---|---|---|
| 2,749,523 | 6/1956 | Dishal | 333/212 |
| 3,142,028 | 7/1964 | Wanselow | 333/211 |
| 3,882,434 | 5/1975 | Levy | 333/212 |
| 3,899,759 | 8/1975 | Hines et al. | 333/212 |
| 3,919,673 | 11/1975 | Kostelnick | 333/24.2 |
| 4,218,666 | 8/1980 | Snyder | 333/211 |
| 4,543,543 | 9/1985 | Blight et al. | 333/24.1 |
| 4,945,324 | 7/1990 | Murakami et al. | 333/202 |
| 4,983,936 | 1/1991 | Murakami et al. | 333/202 |
| 4,998,080 | 3/1991 | Hanna | 333/202 |

FOREIGN PATENT DOCUMENTS

| | | | |
|---|---|---|---|
| 0138902 | 10/1980 | Japan | 333/110 |
| 0075704 | 6/1981 | Japan | 333/202 D R |
| 0120301 | 7/1983 | Japan | 333/202 D R |
| 4-035505 | 2/1992 | Japan | 333/202 D R |

OTHER PUBLICATIONS

Instruction Sheet Jerrold Model 3880 Solid State High Output VHF Broadband Amplifier, #435–674–03, published by Jerrold Electronics Corporation Apr. 1973.

*Primary Examiner*—Benny T. Lee
*Assistant Examiner*—Justin P. Bettendorf
*Attorney, Agent, or Firm*—W, H. Meise; C. A. Berard; S. A. Young

[57] ABSTRACT

A notch filter includes a directional coupler (16) with an input port (17a), coupled output port (17b), coupled 0° (17d) and direct 90° (17c) ports. A cylindrical dielectric resonator (40) is supported by a spacer (58) above a ground plane (14) and dielectric substrate (12). A first microstrip transmission line includes a strip conductor (22) coupled at one end to the coupled 0° port, and extending parallel to a tangent to the edge of the resonator at a central plane (44), terminating in an open-circuit (226). A second transmission line includes a strip conductor (24) coupled to the direct 90° port (17c) and extending parallel to the first transmission line, on the other side of the resonator. The first and second transmission lines each have an electrical length λ/4 between the central plane (44) and their open-circuit terminations, to reflect a high current to the plane. The high current represents maximum transmission line current, for maximizing coupling to the resonator. An offset metal plunger generates a higher-order mode, which is combined with the fundamental to improve rejection at the notch.

9 Claims, 6 Drawing Sheets

DIELECTRIC RESONATOR NOTCH FILTER WITH A QUADRATURE DIRECTIONAL COUPLER

This invention relates to notch or stopband filters for rejecting signals within a frequency range, and more particularly to such filters using dielectric resonators.

Many applications and systems require the use of notch filters. One specific application is in 6 GHz - 4 GHz satellite transponder systems, in which signals are sent at 6 GHz over an uplink to a communications spacecraft, and the signal is converted to 4GHz in the spacecraft for transmission over a downlink to an Earth station. Such systems uses a local oscillator at 2.225 GHz to perform the frequency conversion. A system problem which is often encountered is the need to prevent the second harmonics of the local oscillator signal, at 4.450 GHz, from accompanying the desired converted signals in the range of 3.7 to 4.2 GHz during amplification in the spacecraft, preparatory to entering the downlink. A constant-frequency signal, such as a local oscillator second harmonic, can result in undesirable levels of intermodulation or other distortion in the amplified downlink signals. A notch filter is ordinarily used to reject the local oscillator second harmonic while allowing the desired band of converted information signals to pass unimpeded.

Conventional band-reject or notch filters include those with discrete LC series-resonant circuits coupled across the transmission line, but the quality (Q) of such circuits tends to degrade at RF frequencies, and such LC circuits are essentially unusable above about 200 MHz due to self-resonances. Cavity resonators are used for providing notches, as described, for example, in U.S. Pat. No. 3,142,028, issued Jul. 21, 1964 in the name of Wanselow. A dual-mode stop-band filter using a pair of cavities is described in U.S. Pat. No. 4,218,666, issued Aug. 19, 1980 in the name of Snyder. Cavity resonators tend to be large and heavy, which is undesirable for use in spacecraft. Additionally, the cavity walls tend to change dimensions with temperature, which may require complex frequency compensation techniques.

Improved notch filters are desired.

SUMMARY OF THE INVENTION

A signal including a desired band and an undesired portion is applied to a 90°, 3 dB hybrid or directional coupler. The 90° direct port and the 0° coupled port are coupled by microstrip lines to a dielectric resonator. In one embodiment of the invention, the puck or body of the dielectric resonator has the shape of a right circular cylinder having an axis perpendicular to the microstrip substrate or ground plane, and a first one of the microstrip transmission lines is coupled at one end to the coupled 0° port of the directional coupler, and includes a straight portion extending orthogonally past the projection of a radial or diameter passing through the axis of the resonator puck. The second of the microstrip lines is coupled at one end to the direct 90° port of the directional coupler, and includes a straight portion extending past the body, orthogonal to a projection of the diameter on the other side of the puck of the resonator, or perpendicular to a radial 180° from the first radial. The two microstrip lines couple to the resonator in a manner which causes destructive interference of the signal on the directional coupler through path when the signal is near the resonant frequency of the dielectric resonator. According to another aspect of the invention, a tuning capacitor or plunger is mounted offset from the axis of the resonator to induce a second mode, which results in a notch with a deeper bottom or steeper sides. The resonator is housed in a body, and compensated for frequency variations induced by the housing.

DESCRIPTION OF THE INVENTION

Figure 1:
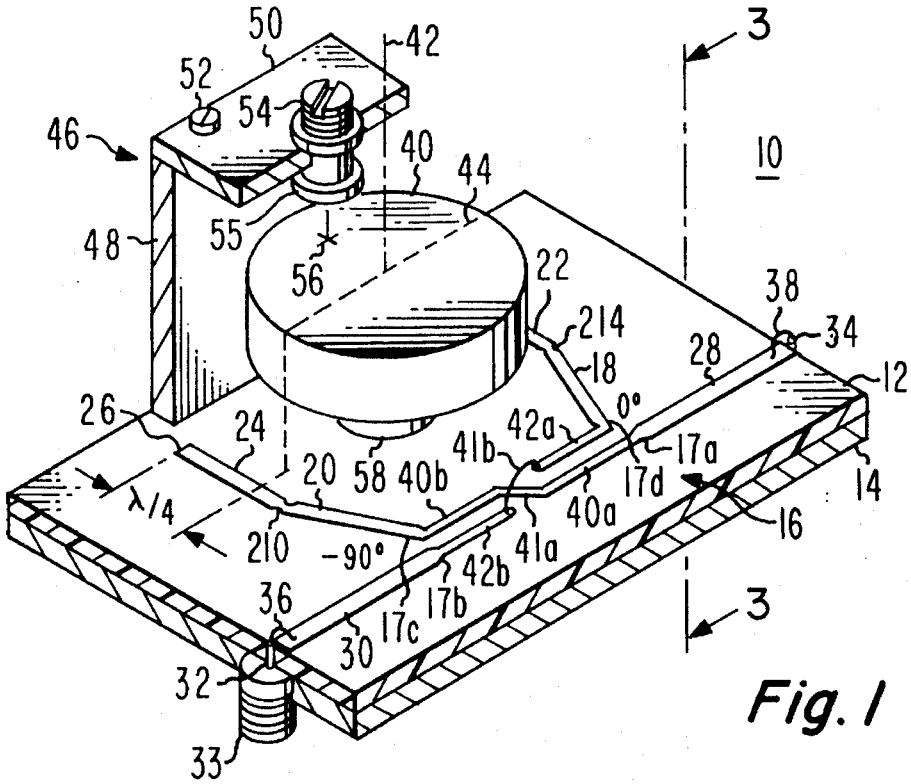
FIG. 1 is a perspective or isometric view, partially cut away to reveal interior details, of a notch filter according to the invention.

In FIG. 1, a notch filter 10 includes an electrically conductive gold-plated Titanium (or Kovar) ground plane 14, which supports a dielectric slab or substrate 12 of alumina (aluminum oxide). A 90°, 3 dB directional coupler or hybrid 16 includes elongated, mutually parallel strip conductors 40*a*, 42*a* and 40*b*, 42*b* extending along the upper surface of substrate 12. Conductors 40*a* and 40*b* are directly connected by a crossover 41*a*, and conductors 42*a* and 42*b* are connected by a jumper wire 41*b*. Signals to be notch filtered are coupled into directional coupler 16 at an input port 17*a* by a connecting pin 34 of a coaxial connector (not otherwise visible), a jumper wire 38, and an elongated strip conductor 28. Notch-filtered signal is taken from directional coupler 16 at an output port 17*b* by a strip conductor 30, a jumper wire 36, and a connecting pin 32 of a coaxial connector 33.

As notoriously well known to those skilled in the art, strip conductors such as 28, 30, 40 and 42, spaced apart from a ground plane 14 by a sheet 12 of dielectric, form microstrip transmission lines capable of conveying signals in much the same manner as coaxial cables. However, microstrip transmission lines have fields which extend outward from the strip conductor, and which can interact with surrounding structures, unlike conventional coaxial cables. Typically, microstrip transmission lines are configured to provide a 50-ohm characteristic impedance, but may be configured to other impedances to aid in impedance matching, tuning and the like.

Three-dB quadrature directional couplers, such as directional coupler 16, are also notoriously well known, being described, for example, in U.S. Pat. No. 4,602,227, issued Jul. 22, 1986 in the name of Clark et al.; and U.S. Pat. No. 5,146,177, issued Sep. 8, 1992 in the name of Katz et al. The salient aspect of a 3 dB, quadrature or 90° directional coupler is that the through transmission path has a length of approximately $\lambda/4$ in the operating band, which provides a phase shift of about −90° between input port 17*a* and its direct port 17*c*. That one of the ports of the coupled transmission line which is adjacent input port 17*a* of the directional coupler, namely port 17*d*, has nominally 0° phase shift, and port 17*b* of the coupled transmission line has a nominal −90° phase shift relative to the signal at port 17*d*.

Figure 2:
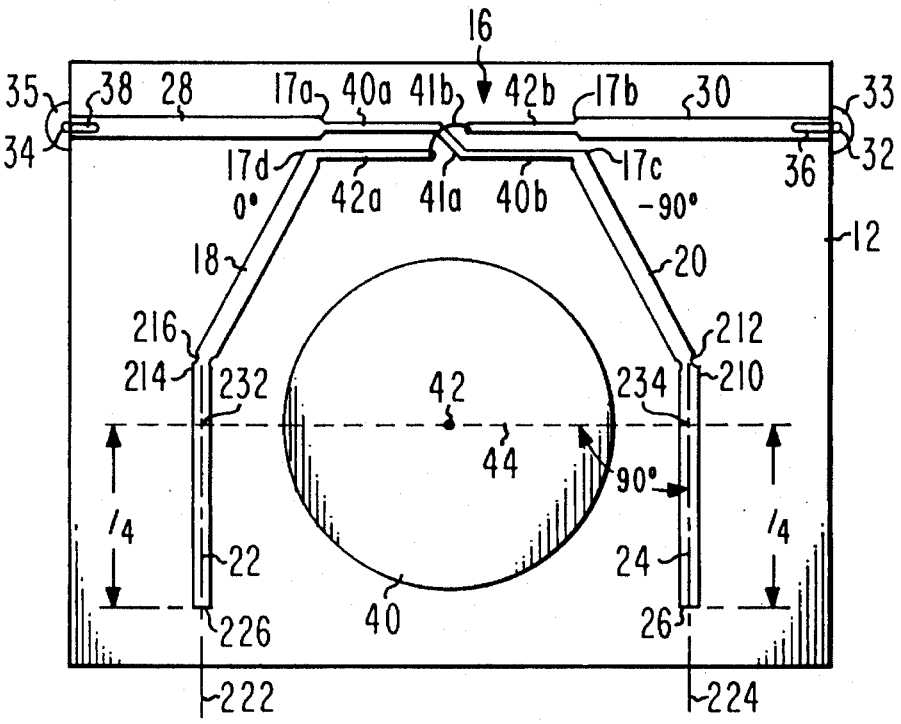
FIG. 2 is a plan view of the directional coupler and dielectric resonator of FIG. 1.
Figure 4:
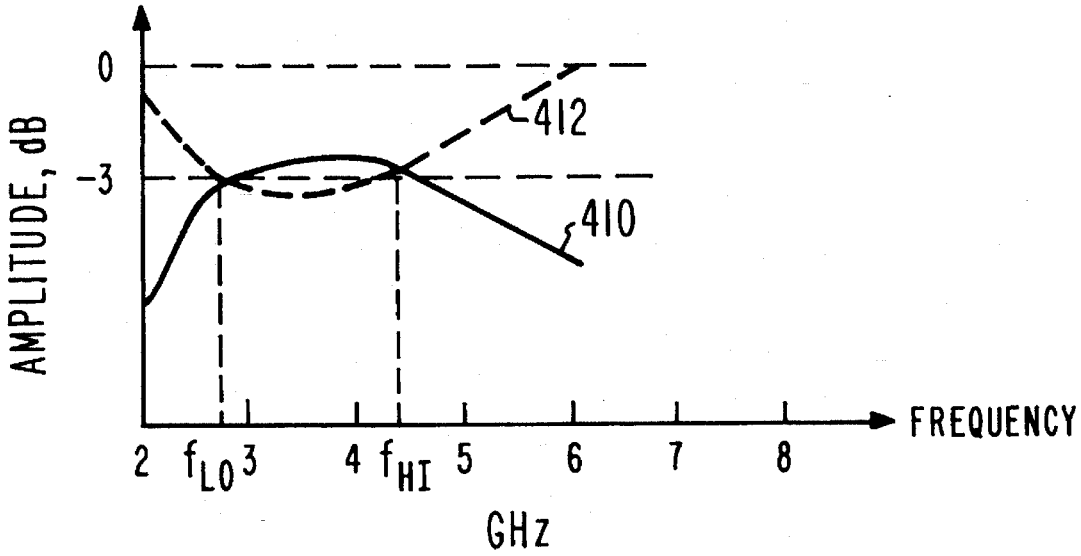
FIG. 4 is a plot of the amplitude characteristics of the directional coupler of FIGS. 1 and 2.

For purposes of explanation, pin 34 of FIGS. 1 and 2 is assumed to be the input port (although connector 33 could be the input instead) of the notch filter. The frequency range of directional coupler 16 is selected to cover the range of signals to be passed. In an embodiment for passing signals in the range of 3.7 to 4.2 GHz, the directional coupler may have a range of operation encompassing that range. FIG. 4 illustrates a plot 410 of the coupling between input port 17*a* and port 17*d* of directional coupler 16 with other ports terminated in the characteristic impedance, and plot 412 represents the corresponding coupling between ports 17*a* and 17*c*. The useful range extends at least from $f_{LO}$=2.6 GHz to $f_{HI}$=4.5 GHz. The notch frequency, described below, is set to $f_{HI}$.

In FIGS. 1 and 2, elongated strip conductor 18 is connected to port 17*c* (the coupled 0° port) of directional coupler 16, and elongated strip conductor 20 is connected to port 17*d* (the direct 90° port). As illustrated in more detail in FIG. 2, strip conductor 20 connects with a further strip conductor 24 at a bend 210, and includes an impedance-matching notch or narrowing 212 adjacent bend 210 to introduce an inductive component to compensate for excess capacitance at bend 210. Strip conductor 24 connects at bend 210 to strip conductor 20, and ends at an open-circuit 26. As can more readily be seen in FIG. 2, the end of strip conductor 18 is connected at a bend 214 to another elongated strip conductor 22 and includes a narrowing or notch 216 adjacent bend 212. Strip conductor 22 terminates in an open circuit 226.

Figure 3:
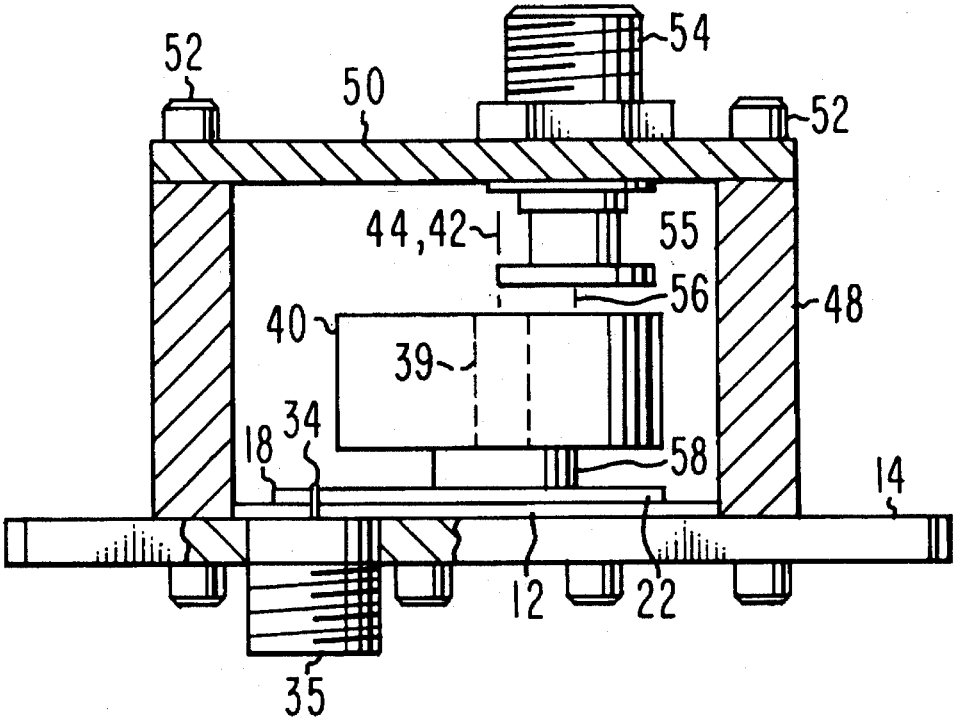
FIG. 3 is a side elevation view of a cross-section of the arrangement of FIG. 1 looking in the direction 3—3.

As illustrated in FIGS. 1, 2, and 3, a dielectric resonator puck 40 is mounted above the upper surface of dielectric sheet 12 by a spacer 58. Dielectric resonator 40 is in the form of a right circular cylinder defining an axis 42. Axis 42 is perpendicular to the surfaces of dielectric sheet 12 and ground plane 14. Spacer 58 is also in the form of a right circular cylinder coaxial with axis 42.

In one embodiment of the invention for passing signals from 3.7 to 4.2 GHz and having a notch at 4.450 GHz, dielectric resonator puck 40 is 0.233 inches high and has a diameter of 0.515 inches, and has a central bore 39 with a diameter of 0.083 inches. It is made from a ceramic Titanium Oxide dielectric material, type D8515, made by Trans Tech, Inc., the address of which is 5520 Adamstown Road, Adamstown, Md. 21710. This material has a nominal temperature characteristic of 0 parts per million/°C., with dopants selected by Trans Tech, Inc. for a precision of ±2 PPM/°C. over a wide temperature range. Spacer 58 is type SPT-236-A-050, also supplied by Trans Tech, Inc., 0.236 inches in diameter and 0.050 inches high. The spacer, according to the specification sheet, is a hollow Cordierite composition of Mg, Al and Silicate, with a coefficient of thermal expansion of 2.4 PPM/°C. over a wide temperature range. As described below, this is selected to aid in temperature compensating the notch filter for the effects of its housing, also described below. Spacer 58 is adhesively affixed to puck 40 and to substrate 12 by a low-loss adhesive, such as a single-component epoxy adhesive type 84-3 made by Ablestik Laboratories, whose address is 833 W. 182$^{nd}$ Street, Gardena, Calif. 90248.

In FIGS. 1 and 2, a plane illustrated as a dash line 44 contains axis 42 of dielectric resonator 40. Plane 44 is orthogonal to the upper and lower surfaces of dielectric sheet 12. As illustrated in FIG. 2, strip conductor 22 defines an axis of elongation 222 lying parallel to the surface of dielectric sheet 12, and strip conductor 24 defines an axis of elongation 224 parallel to axis 222. According to an aspect of the invention, a point 232 on axis 222 of strip conductor 22, which lies one quarter wavelength (λ/4) from open-circuited end 226, also lies in plane 44, and corresponding point 234 on axis 224 of strip conductor 24 is λ/4 from open-circuit 26, and also lies in plane 44. This arrangement has the advantage of placing a region of high electrical current on the transmission lines including strip conductors 22 and 24 at locations nearest the body of resonator 40. The high current occur at points 232 and 234, which are diametrically opposed to each other relative to axis 42, or which lie on radials (not illustrated) from axis 42 which are 180° apart. At the high-current locations 232 and 234, the axes of elongation 222 and 224 of strip conductors 22 and 24, respectively, are parallel to tangents to the resonator body or puck. The high current on the transmission line results from the low impedance on the transmission line at a point λ/4 from the high impedance of an open circuit. The characteristics of transmission lines are described in numerous sources, including the text Microwave Transmission Design Data, by Moreno, published by Dover in 1958, Lib. Congress Cat. No. 58-11278. The positioning according to the invention maximizes coupling into the puck of the dielectric resonator. The amount of coupling can be increased by moving lines 22 and 24 toward resonator puck 40, with maximum coupling when they are directly under the edge of the puck.

FIGS. 1 and 3 illustrate another aspect of the invention. In FIGS. 1 and 3, an adjustable capacitor 54 is affixed to a lid 50 for moving a metal plunger 55 toward or away from dielectric resonator body 40 in order to adjust the frequency of a first mode of operation of resonator 40. When plunger 55 of capacitor 54 is centered on axis 42 of dielectric resonator puck 40, a tuning range of about five percent of the resonant frequency is available for a motion from 0.200 inches above the puck to 0.020 inches above the puck. However, the notch is narrow, and temperature drift attributable to capacitive effects of the housing may cause the notch to drift away from the signal whose amplitude is to be reduced or nulled, which in the downlink example may result in increasing distortion in the desired signals. The drift of the null may be due to the thermal expansion and/or contraction of the walls of the housing, which directly affects the capacitance between the housing walls and the puck, and the drift may also be due in part to the effect of thermal expansion and contraction of the housing walls on the position of capacitor 54 and its plunger 55. Making side walls 48 from aluminum was found to aid in stabilizing the temperature response with the above-described Cordierite spacer.

Figure 5:
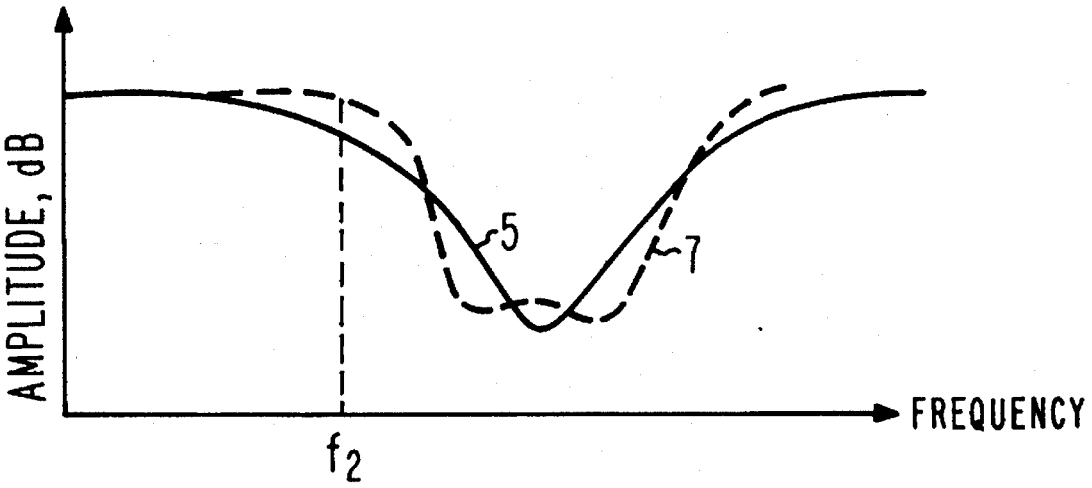
FIG. 5 is an idealized plot illustrating the characteristics of a double-tuned circuit.

According to an aspect of the invention, plunger 54 is offset from axis 42, so that, as the plunger approaches body 40 of the resonator, the frequency of the fundamental $TE_{01\beta}$ mode rises, and the frequency of a second, high-order $HE_{11\beta}$ mode decreases, where the subscript β indicates a circular mode. When these two modes overlap in frequency, a notch response similar to a double-tuned response occurs, which tends to have steeper shoulders and/or a deeper notch than a single-tuned response, and which thereby provides more rejection at the undesired frequency, with equal effect on adjacent frequencies which are passed. FIG. 5 illustrates a single-tuned response by a solid line 5, and a double-tuned response by a dash line 7. At a given frequency, such as frequency $f_2$, at which frequencies adjacent to the notch are to be passed, the double-tuned response 7 has loss similar to that of a single-tuned response, but with improved notch depth.

While adjustment of the depth of plunger 55 results in moving the frequencies of the fundamental and higher-order mode toward each other, the frequency at which they coincide may not be the desired frequency. The dimensions of puck 40 are initially selected to provide the coincidence at too low a frequency (a frequency below the desired frequency), and the upper surface of the puck is then shaved to bring the resonant frequency of the two modes to the desired value, which is 4.45 GHz in the example.

Figure 6:
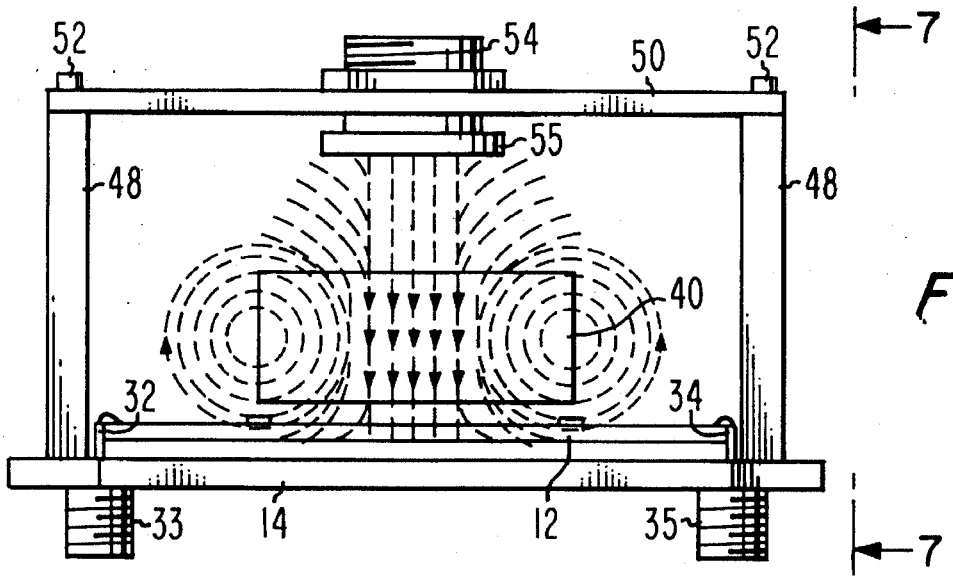
FIGS. 6, 7 and 8 illustrate field lines associated with a right circular cylindrical dielectric resonator.
Figure 7:
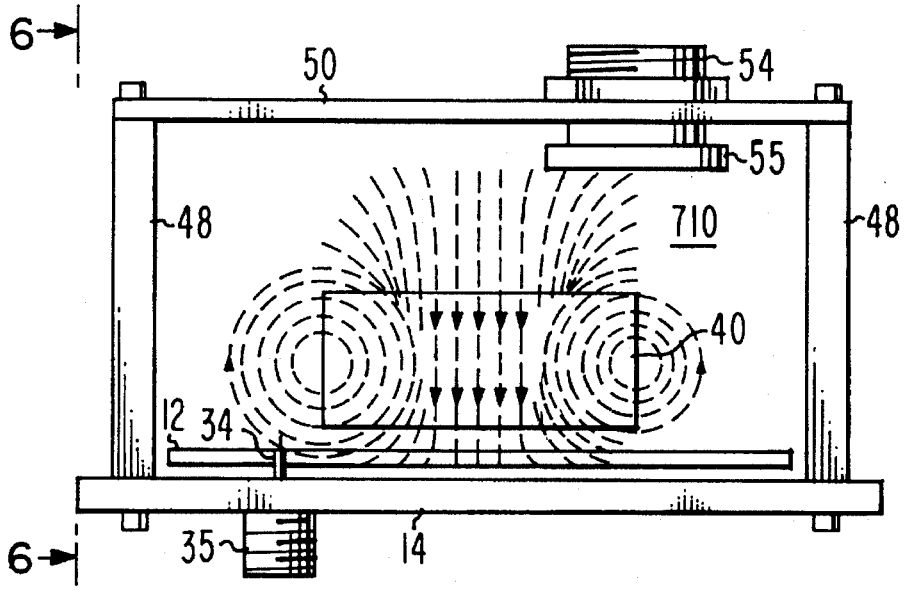
Figure 8:
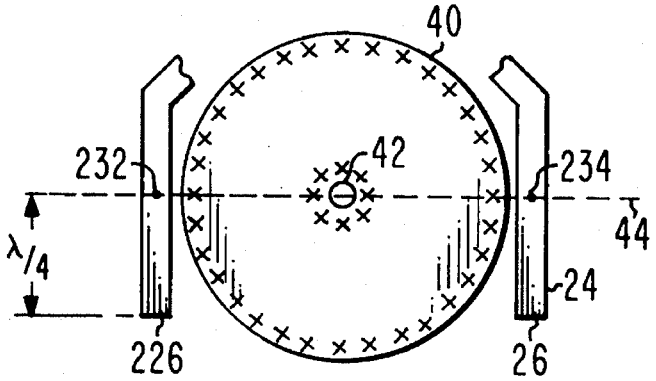

FIG. 6 is a frontal view of the structure of FIGS. 1, 2 and 3, illustrating the magnetic fields associated with resonance of puck 40 in the presence of plunger 55, and FIG. 7 is a side view of the structure of FIG. 6. In FIGS. 6 and 7, the magnetic fields are represented by dash lines. The magnetic fields form a toroidal magnetic structure, which is visible in the views of FIGS. 6 and 7 as "whorls" or circular structures. Plunger 55 is symmetrical relative to the magnetic field whorls at right and left as seen in FIG. 6, but is offset toward the rear, as illustrated in FIG. 7. The presence of plunger 55 offset toward the rear of the magnetic field structure as in FIG. 7 "compresses" rearmost portion 710 of the field whorl relative to the forward portion, thereby contributing toward generation of the higher-order mode. FIG. 8 is a plan view of the resonator, which represents the magnetic fields in the puck of FIGS. 6 and 7, showing the magnetic fields by $X_s$. The magnetic field density is greater adjacent points 232 and 234.

Figure 9:
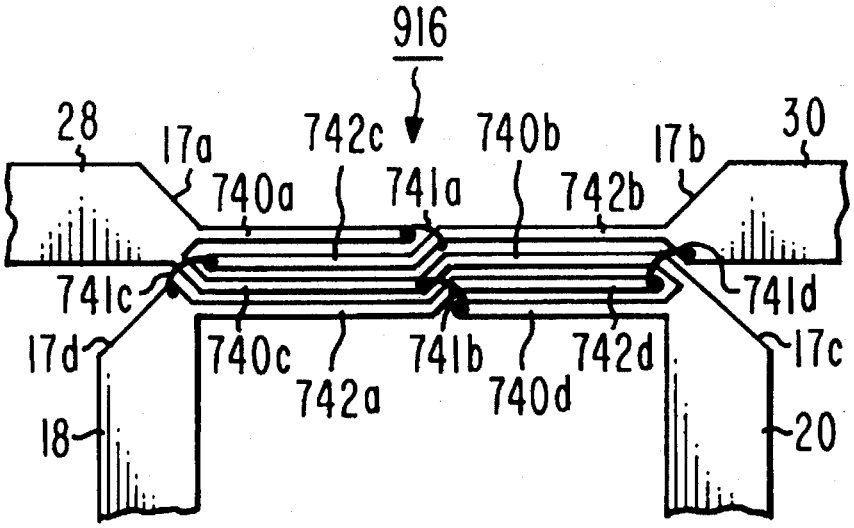
FIG. 9 illustrates a preferred directional coupler configuration.

Notch filter 10 operates, in general, by coupling energy from the directional coupler to the dielectric resonator, receiving the reflected energy, and combining the reflected energy out-of-phase to create the notch. The through loss of the notch filter at frequencies away from the notch is determined, in part, by the losses in the two legs coupled to the resonator, and by the losses of the resonator itself. The microstrip transmission lines and the dielectric resonator are characterized by low loss. The depth of the notch is determined, in part, by the phase accuracy with which the mutually out-of-phase signals can be combined. The simple coupler illustrated in FIGS. 1 and 2 is effective for limited notch depths. FIG. 9 outlines the pattern of a Lange-style coupler which provides improved performance. In FIG. 9, the ends of transmission line strip conductors 18, 20, 28 and 30 are tapered to a narrow width where they join the strip conductors 740, 742 of coupler 916. Strip conductor 28 connects directly to a coupler strip 740*a* at port 17*a*, and also connects directly to another coupler strip 740*c*. Strip conductor 30 connects directly to a coupler strip 742*b* at port 17*b*. Coupler strip 742*b* is coaxial with coupler strip 740*a*, and connects to the right end of coupler strip 742*c*. Coupler strip 742*c* lies between coupler strips 740*a* and 740*c*, and has its left end connected by a jumper 741*c* to strip conductor 18 at port 17*d*. Strip conductor 20 connects directly to a coupler strip 740*b* and a coupler strip 740*d*. Coupler strip 740*b* is coaxial with coupler strip 742*c*, and coupler strip 740*d* is coaxial with coupler strip 742*a*. A coupler strip 742*d*, lies between coupler strips 740*b* and 740*d*, is coupled directly to the right end of coupler strip 742*a*, and is coupled at its right end, by a jumper 741*d*, to strip conductor 30 at port 17*b*. A jumper 741*a* couples the right end of coupler strip 740*a* to the junction of coupler strips 740*b* and 742*c*, and a jumper 741*b* couples the left end of coupler strip 740*d* to the junction of coupler strips 740*b* and 740*c*.

Figure 10:
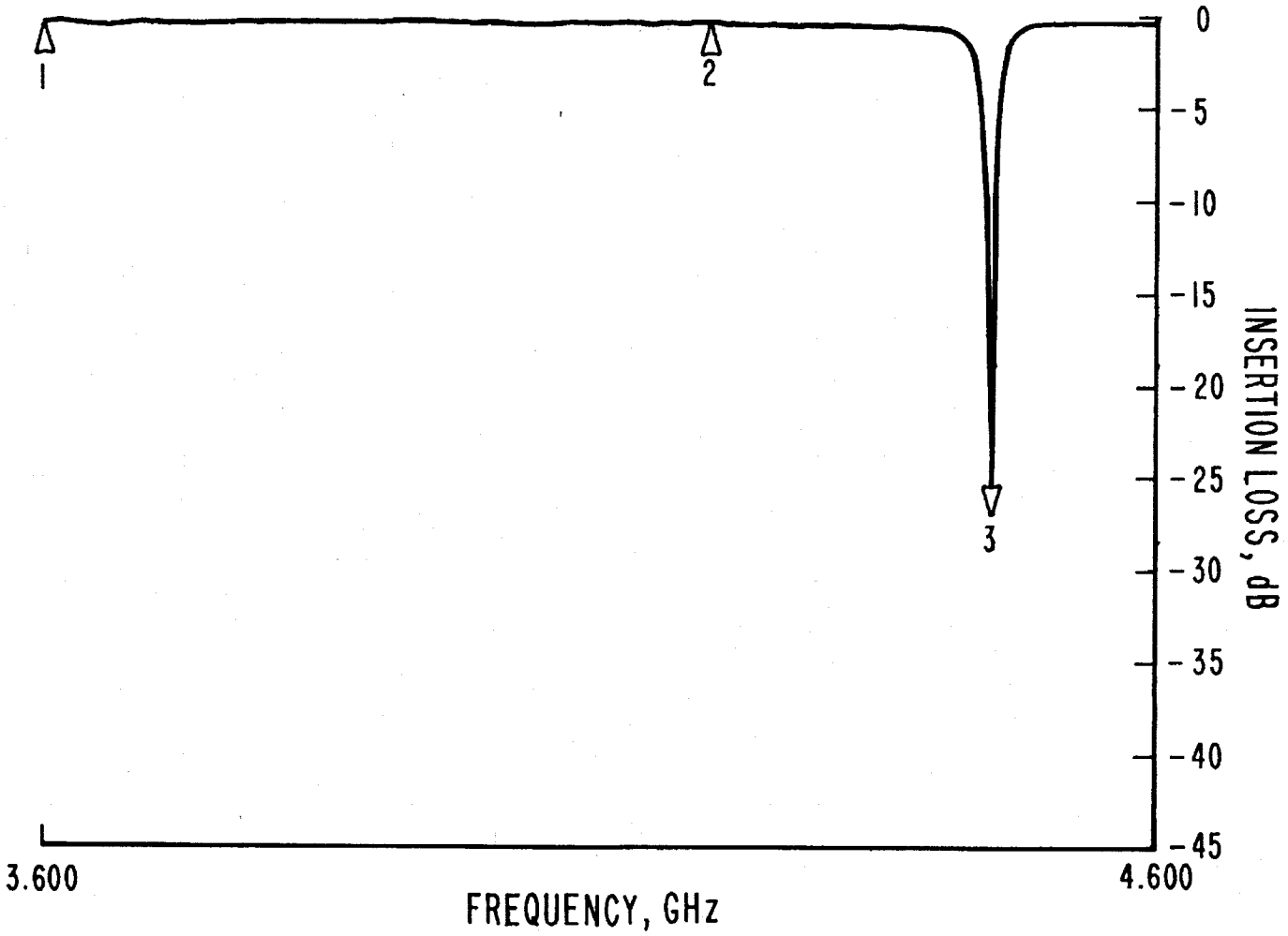
FIGS. 10 and 11 are amplitude-versus-frequency plots of notch filters according to the invention.
Figure 11:
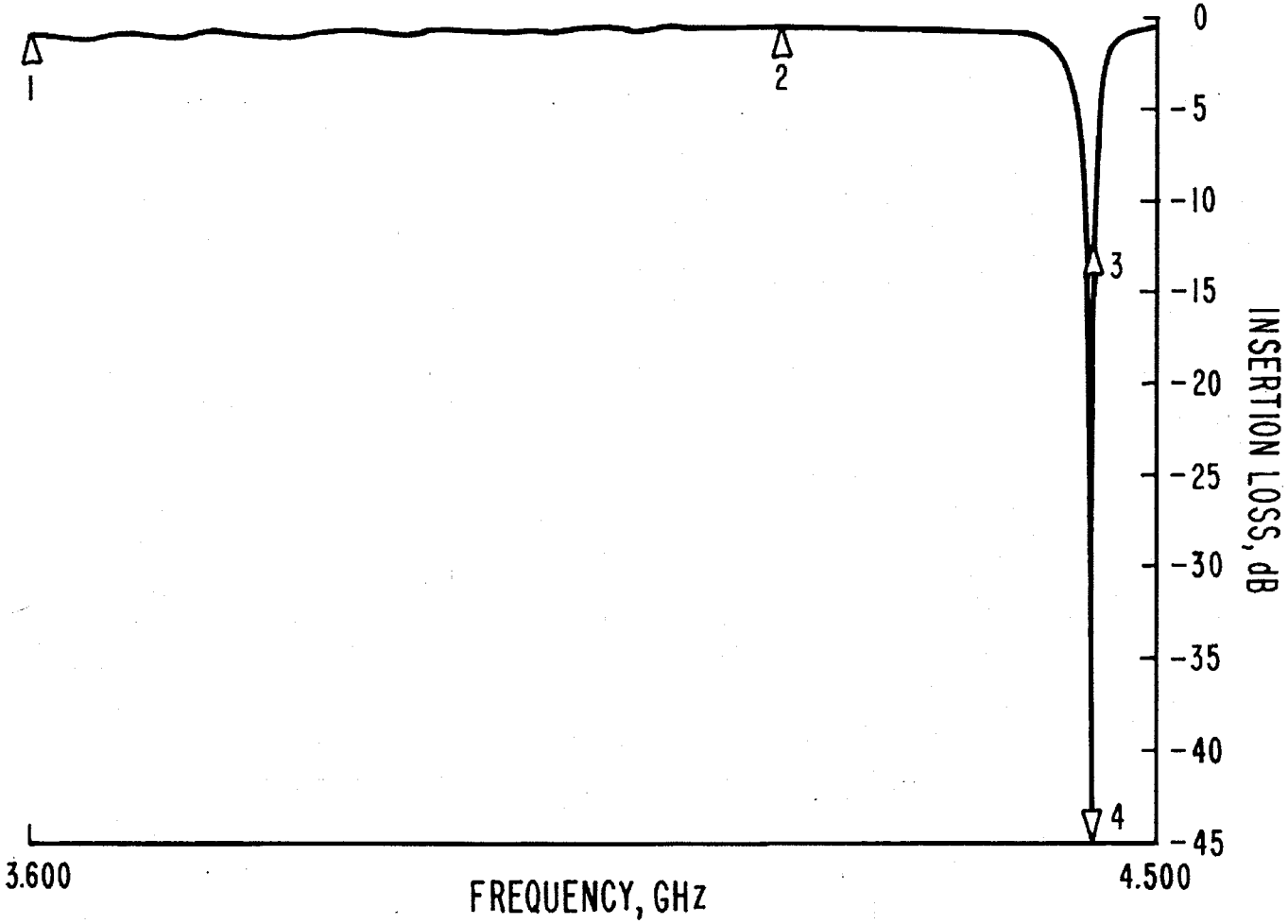

FIG. 10 plots the frequency response of a breadboard notch filter according to the invention, in which the higher-order resonator mode is not superposed on the fundamental mode. The notch depth attributable to the fundamental mode is about 27 dB, and the through loss at markers 1 and 2 is about 0.37 dB. FIG. 11 plots the frequency response of another notch filter, with plunger adjusted to bring the fundament and higher-order modes into congruence, but with the dielectric resonator puck unshaved, so the notch is at too low a frequency. The notch is about −45 dB, a significant improvement over the 27 dB achieved with the fundamental mode alone in FIG. 10.

Other embodiments of the invention will be apparent to those skilled in the art. More particularly, transmission lines 22 and 24 may have strip conductors which are tapered to a greater width adjacent the open-circuit termination to reduce the effects of fringing capacitance, and a lesser width at points 232 and 234, to increase the impedance by transformation. A pair of narrowings such as 216 of strip conductor 18 could be placed on each side of the bend, to turn the excess capacitance of the bend into a low-pass filter.

What is claimed is:

1. A notch filter, comprising:

a dielectric resonator including a body defining an axis;

a quadrature directional coupler including an input port, a coupled port having a nominal 0° reference phase, a direct port having a nominal 90° phase relative to said reference, and an isolated output port;

a first microstrip transmission line including a ground plane perpendicular to said axis of said body of said dielectric resonator, and also including a first strip transmission path spaced apart from said ground plane, said first strip transmission path defining an axis of elongation, said first strip transmission path being coupled at a first end with said coupled 0° port and terminating at a second end in an open circuit, said first strip transmission path lying parallel to said ground plane, and being located relative to said body of said dielectric resonator so that a first radial extending from said axis of said body of said dielectric resonator is orthogonal to said axis of elongation of said first strip transmission path, and crosses said axis of elongation of said first strip transmission path at a location lying between said first end and said second end of said first strip transmission path; and a second microstrip transmission line including said ground plane and also including a second strip transmission path spaced apart from said ground plane, said second strip transmission path defining an axis of elongation, said second strip transmission path being coupled at a first end with said direct 90° port, and terminating at a second end in an open circuit, said second strip transmission path lying parallel to said ground plane, and being located relative to said body of said dielectric resonator so that a second radial orthogonally intersects said second transmission path at a location lying between said first and second ends of said second strip transmission path, said second radial extending from said axis of said body of said dielectric resonator coaxial with said first radial and oriented 180° from said first radial relative to said axis of said body of said dielectric resonator.

2. A filter according to claim 1, wherein said directional coupler is a microstrip directional coupler.

3. A filter according to claim 1, further comprising capacitance means spaced away from, but coupled to, a surface of said body of said dielectric resonator.

4. A filter according to claim 1 wherein said body of said dielectric resonator is in the shape of a right circular cylinder symmetric with said axis of said body, and with a planar end surface transverse to said axis of said body.

5. A filter according to claim 4, wherein the electrical length of said first microstrip transmission path, between said open circuit and the intersection of said axis of said first strip transmission path with said first radial, is near $\lambda/4$ at the frequency of the notch.

6. A filter according to claim 5, wherein the electrical length of said second microstrip transmission path, between said open circuit and the intersection of said axis of said second strip transmission path with said second radial, is near $\lambda/4$ at said frequency of said notch.

7. A filter according to claim 1 wherein said body of said dielectric resonator is cylindrical.

8. A filter according to claim 7 wherein said dielectric body is spaced away from said ground plane by a dielectric spacer.

9. A filter according to claim 8, wherein said dielectric spacer includes a portion in the shape of a right circular cylinder having a smaller diameter than said body, said spacer being coaxial with said axis of said body.

* * * * *